US006955504B2

(12) United States Patent
Leibhard et al.

(10) Patent No.: US 6,955,504 B2
(45) Date of Patent: Oct. 18, 2005

(54) ATTACHMENT ELEMENT

(75) Inventors: Erich Leibhard, Munich (DE); Robert Gienau, Westendorf (DE); Wolfgang Ludwig, Schwabmünchen (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/761,544

(22) Filed: Jan. 20, 2004

(65) Prior Publication Data

US 2004/0206553 A1 Oct. 21, 2004

(30) Foreign Application Priority Data

Jan. 20, 2003 (DE) ..... 103 01 968

(51) Int. Cl.[7] ..... E02D 20/02
(52) U.S. Cl. ..... 405/259.5
(58) Field of Search ..... 405/259.6, 259.5, 405/259.1

(56) References Cited

U.S. PATENT DOCUMENTS 4,055,051 A * 10/1977 Finney ..... 405/259.6
4,322,183 A * 3/1982 Ciavatta ..... 405/259.6
6,457,910 B1 * 10/2002 Ludwig et al. ..... 405/259.6
6,468,010 B2 * 10/2002 Sager et al. ..... 405/259.5
6,491,478 B2 * 12/2002 Sager et al. ..... 405/259.6

FOREIGN PATENT DOCUMENTS

DE 10017763 * 11/2001

* cited by examiner

*Primary Examiner*—Frederick L. Lagman
(74) *Attorney, Agent, or Firm*—Abelman, Frayne & Schwab

(57) ABSTRACT

An attachment element (1;51), includes a boring head (5), a hollow cylindrical receiving body (2; 53) having, at its end (4) facing in a setting direction (S) of the attachment element (1; 51), a recess for receiving the boring head (5) and at its opposite end (6), an engagement element (7), the attachment element further having at least one outlet opening (10.1; 10.2) through which a mortar mass located in the receiving body (2; 53) is squeezed out under a pressure applied by a piston (27), a channel section (29) extending between the mortar mass and the at least one outlet opening (10.1; 10.2), and an inner tube (21; 52) arranged in the receiving body (2; 53) at a predetermined distance from an inner wall of the receiving body (2; 53) for forming at least one suction channel (22; 42.1; 42.2) and in which the mortar mass and the channel section (29) are arranged.

13 Claims, 3 Drawing Sheets

ATTACHMENT ELEMENT

BACKGROUND OF THE INVENTION

1 Field of the Invention

The present invention relates to an attachment element and, in particular, to a rock anchor for use in mining and/or tunnel driving and including a boring head and a hollow cylindrical receiving body. The receiving body has, at its end, facing in a setting direction of the attachment element, a recess for receiving the boring head and at its opposite end, an engagement element. In the receiving body, there is provided one or multi-component mortar mass, preferably packed in a bag. The attachment element is provided with at least one outlet opening through which the mortar mass is squeezed out under pressure applied by piston. Between the mortar mass and the at least one outlet opening, a channel section is provided.

2. Description of the Prior Art

Rock anchors are used for stabilization of walls of hollow spaces such as tunnels, galleries, and the like and, in particular, for connecting rock regions adjacent to a wall with each other. In many cases, the regions which are located immediately adjacent to the wall and mechanical characteristics of which, in particular the load-carrying capacity, are reduced as a result of formation of hollow spaces, are connected to more remote, undamaged regions. The wall, in this regard, means the ceiling and side walls of a hollow space and also its bottom.

As a rock anchor, e.g. a so-called tubular anchor, which is formed of a tubular element provided, at its setting direction end, with a boring head and at its opposite end, with engagement means, is often used. At least one outlet channel extends through the boring head. The setting process of the known tubular anchor is effected into two steps. In the first step, the anchor is drilled, with an available boring tool, into the ground, in particular, rock. The degraded and comminuted stone, which is produced at the bore-side end of the anchor by the boring head, is removed through the outlet openings and the space between the bore wall and the outer circumference of the tubular anchor. In the second step, a mortar mass is introduced into the tubular member through the anchor end remote from the setting direction end of the anchor, and is pressed into the direction toward the bore by a piston and with the plunger of squeezing device. The mortar mass, which is located in the tubular anchor, is introduced into the bore from the tubular anchor through the outlet opening in the boring head. The mortar mass is distributed along the space or gap between the bore wall and the outer circumference of the tubular anchor. In this way, the known tubular anchor is anchored and/or secured.

The introduction of the mortar mass into the tubular anchor after the boring step is associated with additional, in particular timewise expenses, on one hand, and on the other hand, can be effected, dependent on the site conditions, only conditionally and often only using very expensive technical measures. Sometimes, the anchoring is not of adequate quality, which can lead, in the worst case, to replacement of the installed anchor.

German Publication DE-100 17 750 A1 discloses a rock anchor containing to-be-squeezed out mortar mass. The tubular anchor is provided, at its setting direction end, with outlet openings. Between the multi-component mass and the outlet openings, there is provided a mixer, so that the mortar mass, which is subject to pressure by a piston, is adequately mixed before it leaves the tubular body.

The drawback of the anchor disclosed in DE-100 17 750 A1 consists in that in order to insure removal of the comminuted stone which is produced by the boring head, the so-called drillings, a sufficiently large gap should be provided between the bore wall and the outer wall of the tubular body. To this end, the bits of the boring head should project sufficiently far beyond the cross-section of the tubular body. To insure anchoring of this rock anchor in a borehole, a large amount of mostly expensive mortar mass should be used, on one hand, and, on the other hand, high requirements are placed on the material characteristics of the mortar mass, e.g., its contraction, shrinkage, during hardening. With an increased thickness of the mortar mass layer, the possibility of failure of contraction during hardening increases.

Accordingly, the object of the present invention is to provide an attachment element, in particular for use in mining and/or tunnel driving, with which the mortar mass is contained in the attachment element during the entire setting process.

Another object of the present invention is to provide an attachment element with which the amount of mortar mass necessary to insure a reliable anchoring is reduced to a minimum.

SUMMARY OF THE INVENTION

These and other objects of the present invention, which will become apparent hereinafter, are achieved by providing an attachment element including a boring head and a hollow cylindrical receiving body having, at its end facing in a setting direction of the attachment element, a section for receiving the boring head and, at its opposite end, an engagement element. In the receiving body, there is provided, preferably packed in a bag, one or multi-component mortar mass. The attachment element has at least one outlet opening through which a mortar mass located in the receiving body is squeezed out under pressure applied by a piston. A channel section extends between the mortar mass and the at least one outlet opening.

The mortar mass and the channel section are arranged in an inner tube. The inner tube is held at a predetermined distance from the inner wall of the receiving body by spacers, which are provided between the inner wall and the outer wall of the receiving body, for forming at least one suction channel.

Through the at least one outlet opening, the drillings, which are formed during boring of the borehole, can penetrate into the receiving body and be removed through the suction channel. The bits project beyond the outer wall of the receiving body only by a small amount. This reduces the gap or the intermediate space between the inner wall of the borehole and the outer wall of the receiving body and the size of which is significantly reduced in comparison with cases when a conventional tubular anchor is used. To insure the anchoring, only a small amount of an expensive mortar mass is required. Because the mortar mass layer is small, the failure of contraction of the mortar mass during the hardening process has a small effect on the reliability of the anchoring.

The size and shape of the inner tube cross-section and the positioning and shape of the spacer(s) determine the cross-section of the suction channel which is provided for removal of drillings. The engagement element, which is provided on the receiving body, insures displacement of the receiving body, together with the boring head, and forming of a borehole. With dry boring, the drillings are aspirated, e.g., continuously through the suction channel.

The boring head is only pinned on the receiving body and is only secured thereon during boring. Whereby, the boring forces and the torques are transmitted to the receiving body, e.g., by a cone provided on the boring head. The boring head can be provided with an inserted bit or be formed as one-piece member of a hard material. For transmitting the forces to the receiving body, the boring head has a sufficiently large support surface.

After a predetermined borehole depth is reached, the piston and the squeezing device apply pressure to the mortar mass, pressing the mortar mass through the channel section and the at least one outlet opening for securing the attachment element in the ground. As the mortar mass, which is stored in a film bag, is being squeezed out, the bag continuously empties and is folded.

The film bag and/or the inner tube can be provided with a lubricant which would facilitate, e.g., mounting of he attachment element. The lubricant, which is provided in the intermediate space between the film bag and the inner tube in form of a thin layer, significantly improves the sliding characteristics of the film bag when it is displaced under pressure. Therefore, only small forces are necessary for displacing the bag, and squeezing devices, which have a reduced power in comparison with the squeezing devices used with conventional rock anchors, are needed. As a lubricant, greases, oils, emulsions, and the like can be used. If the inner tube is formed of steel, a lubricant is selected which in addition to sliding characteristics is also effective as corrosion protection means.

Preferably, at least one outlet opening is provided in the boring head. However, generally, the boring head is provided with optimal number of openings for removing drillings and for providing an adequate suction cross-section in the boring head.

Advantageously, the spacers eccentrically support the inner tube in the interior of the receiving body. In this embodiment of the inventive attachment element, the size of the cross-section of the suction channel is optimized based on the required cross-section of the inner tube and the available size of the inner cross-section of the receiving body. The maximum distance between the outer wall of the inner tube and the inner wall of the receiving body should be of a size corresponding to the maximal size of to-be-produced drillings. In addition to the provision of spacers, in order to optimize the size of the suction channel for insuring a perfect aspiration of drillings, which are produced during the boring process, vanes can be provided on the outer wall of the inner tube or, alternatively, the inner tube can be directly secured to the inner wall of the receiving body, e.g., with glue, by welding, with rivets, etc.

With a non-central position of the inner tube in the receiving body, for positioning of the squeezing device on the receiving body, a setting marking is provided on the engagement element of the receiving body. E.g., with a fixed inner tube, a notch is provided on the engagement element so that an adaptor of the squeezing device can be positioned so that it would insure a correct alignment of the squeezing device with the inner tube. Alternatively, in the region of the engagement element there can be integrated geometry which would insure a proper positioning of the squeezing device and which corresponds to the geometry of the adaptor. Another possibility consists in the provision of grooves in the inner surface of the receiving body along which the spacers, which are provided on the inner tube, can slide for proper positioning of the inner tube with respect to the receiving body.

Preferably the setting direction end of the inner tube is spaced from the boring head. Thereby, a free space between the rear end of the boring head and the setting direction end of the inner tube is provided for deflection of the drillings, which penetrate into the receiving body, into the suction channel. The maintaining of the free space during the setting process of the attachment element can be insured, e.g., by provision of a special spacer on the setting direction end of the inner tube. Another possibility of maintaining of the free space consists in provision of an additional element between the setting direction end of the inner tube and the rear end of the boring head.

Advantageously, the setting direction end of the inner tube is closed by an openable dust cover. The dust cover temporary closes the setting direction end of the inner tube and prevents entry of the drillings into the inner tube. Additionally, the dust cover provides for proper transportation and for securing in place the channel section and the mortar mass that is packed, e.g., in a bag. Upon application of pressure to the mortar mass, the dust cover opens or is pressed off the inner tube so that the mortar mass can flow through the channel section and the outlet openings in the boring head and into the borehole. The dust cover can be formed, e.g., as a diaphragm.

The attachment element according to the present invention can be supplied to a user as a system ready for use, e.g., there can be provided receiving bodies of different materials, as standard products. Likewise, different inner tubes can be received in the receiving bodies of the system. The system can include different mortar masses. With a plurality of receiving bodies and a plurality of boring heads adapted to different types of stone (rock), the system is complete. The separate components of the system can be combined with each other in accordance with particular requirements.

Preferably, on the setting direction end of the channel section, there is provided a break cap. The break cap is so formed that it opens at a predetermined pressure. Thereby, an inadvertent flow of the mortar mass from the channel section is prevented. The break cap can also be formed as a diaphragm.

Advantageously, a mixer is provided in the channel section. A one-component mortar mass cannot often insure obtaining the necessary load value of the attachment with the attachment element set in a borehole in the ground. With a multiple component mortar mass, separate components, e.g., a resinous component and a hardening component, should be kept separate before their use. To provide for a proper intermixing of the mortar mass components, as a mixer, preferably, a static mixer is used which is located in the channel section. Advantageously, the different components of a mortar mass are stored separately from each other in a multi-chamber bag.

By application of pressure to the multi-chamber bag with a piston, which is provided at the inner tube end opposite its setting direction end, the components are mixed so that a uniform mass is obtained before the mortar mass is introduced into the annular gap between the wall of a borehole and the outer wall of the attachment element. Uniform mixing characteristics, which insure an adequate hardening of the mortar mass, are obtained by a proper longitudinal positioning of separate components.

Because squeezing of the mortar mass takes place only after a predetermined borehole depth is reached and the receiving body does not move any more, an increased efficiency and an increased reliability of the anchoring of the attachment member is achieved. Secondary intermixing, which can be caused by rotation of the receiving body and the resulting error, a so-called "gloving" is prevented to a most possible extent.

Advantageously, the dust cover has a tensile resistance which is smaller than that of the break cap. The break cap insures sealing of the channel section and of the mixer, and the dust cover serves essentially for preventing penetration of drillings into the inner tube and as means of insuring proper transportation.

Preferably, the channel section is displaceable in the setting direction. The boring head is provided, optionally, with an inner section for receiving the channel section and with a stop that limits the displacement of the channel section. With a displaceable channel section, the path between the setting direction end of the inner tube and the at least one outlet opening can be bridged. The channel section can be displaced out of the inner tube, e.g., telescopically. When a mixer is provided in the channel section, advantageously, sealing element is provided on the setting direction end of the channel section. The sealing element is arranged on the inner wall of the inner tube and prevents a possible flow of the mixed mortar mass into the gap between the inner tube and the mixer.

When the at least one outlet opening is formed in the boring head, the channel section is preferably displaced onto or into the boring head during the displacement process. The boring head can be provided with a stop edge in its interior. The channel section, which is displaceable out of the inner tube, engages the stop edge with its setting direction end when the channel section reaches a predetermined position.

The stop forms part of the receiving section that sealingly surrounds the channel section when the channel section engages the stop. When the channel section is provided with a sealing element on its setting direction end, the receiving section of the boring head is formed so that it sealingly receives the sealing element. As a result, the mortar mass cannot penetrate into the receiving body or the suction channel, and the entire amount of the mortar mass is available for securing the attachment element. The stop in the boring head prevents the channel section and the mixer, in case the mixer is located in the channel section, from penetrating too far into the boring head and closing the outlet opening.

Advantageously, the channel section and the mortar mass are mechanically decoupled. Upon application of pressure to the mortar mass, the mortar mass container can be jammed in the channel section and/or in the mixer. In particular, with an attachment member according to the present invention having a displaceable channel section, performance capability of the attachment element cannot be insured. The mechanical decoupling between the channel section or the mixer and the mortar mass package frees, on one hand, the front end of the bag and prevents, on the other hand, jamming. The mechanical decoupling can be formed by two, displaceable into each other, element or it may include several elements such as, e.g., locking and anti-locking elements releasably connected with each other and disengageable from each other already at a small load applied thereto.

Advantageously, a guide member is provided between the setting direction end of the inner tube and the boring head. The guide member serves, e.g., as a conveyor element for transporting the mortar mass, which flows out of the setting direction end of the inner tube to the at least one opening. When the channel section is displaceably arranged in the inner tube and the at least one outlet opening is provided in the boring head, the guide member guides the channel section along the displacement path until the channel section reaches its end position in which the mortar mass leaves the channel section. When the inner tube is eccentrically arranged in the receiving body, the guide member is formed, e.g., as a ramp having a semicircular or U-shaped cross-section. The ramp extends between the inner tube and, e.g., the receiving section of the boring head.

To insure connection of the mortar mass, which fills the space between the wall of a borehole and the outer wall of the receiving body, with the outer wall, advantageously the outer wall of the receiving body is provided with an appropriate outer profile.

In order to provide for high load values, the receiving body is formed of steel having a suitable quality and with an appropriate cross-section. The inner tube, the channel section, the mixer, and the guide member are advantageously formed of a suitable plastic material.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
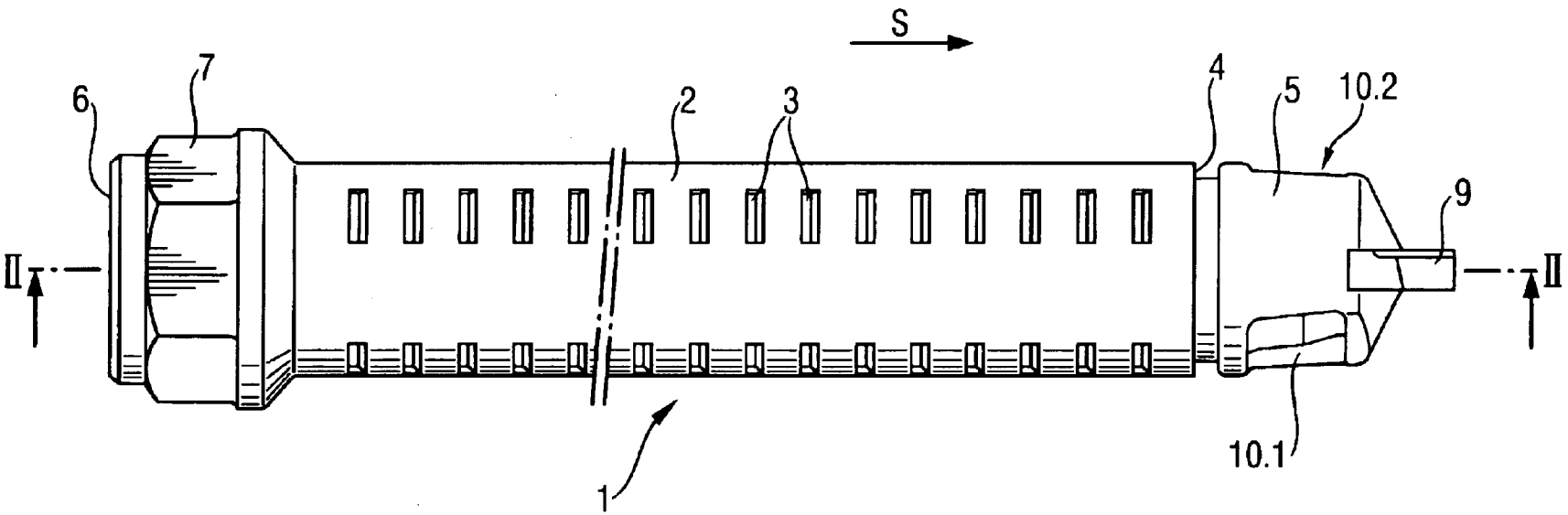
FIG. 1 a perspective view of the attachment element according to the present invention.

An attachment element 1 according to the present invention, which is shown in FIG. 1 has a hollow cylindrical receiving body 2 provided with an outer profile 3. At an end 4 of the attachment element 1 facing in a setting direction S, there is provided means for receiving a boring head 5. At its opposite end 6, the receiving body 2 has a hexagon 7 for connecting the attachment element 1 to a drive tool and a squeezing device (both not shown), using an appropriate adaptor.

The boring head 5 has an inserted bit 9 that only slightly projects past the outer wall of the receiving body 2. The boring head 5 further has two diametrically opposite openings 10.1 and 10.2 through which on one hand, the comminuted stone, the so-called drillings, are removed and which, on the other hand, serve as outlet openings for a mortar mass which is located in the receiving body 2 and is used for securing the attachment element 1 in a borehole (not shown).

Figure 2:
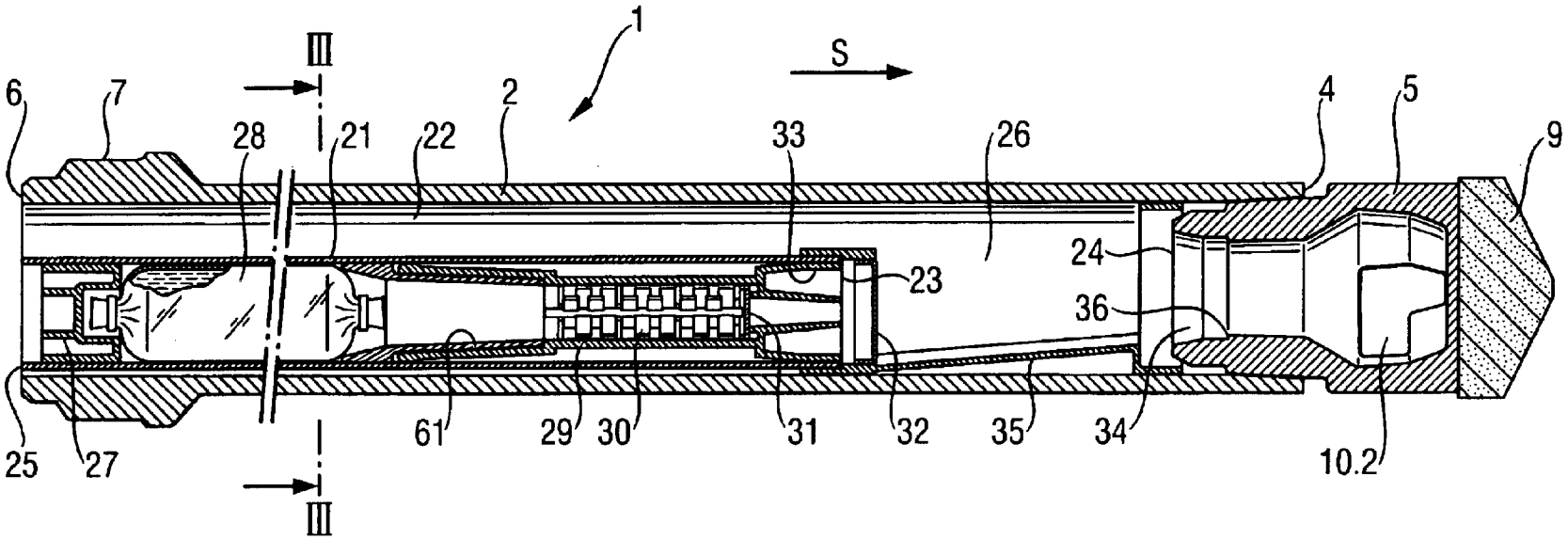
FIG. 2 a cross-sectional view along line II—II in FIG. 1.

A detailed view of the attachment element 1 is shown in FIG. 2. In the receiving body 2 of the attachment element 1, an inner tube 21 is eccentrically arranged. As a result of an eccentric arrangement of the inner tube 21, a suction channel 22 for the to-be-produced drillings is formed between the inner wall of the receiving body 2 and the outer wall of the inner tube 21. The end 25 of the inner tube 21, which faces in the direction opposite the setting direction S is flush aligned with the end 6 of the receiving body 2. The end 23 of the inner tube 21 facing in the setting direction S is spaced from al rear end 24 of the drilling head 5. With the inner tube end 23 being spaced from the rear end 24 of the boring head 5, a necessary free space 26 for deflection of the drillings, which penetrate into the receiving body 2, is provided.

In the inner tube 21, there is provided, viewed from the end 25 thereof facing in the direction opposite the setting direction S, a piston 27, a film bag 28, and a channel section 29 in which a static mixer 30 is arranged. Between the film bag 28 and the channel section 29, a bearing part 61 is provided in the inner tube 21. Immediately behind the static mixer 30, a break cap 31 is provided. The end 23 of the inner tube 21, which faces in the setting direction S, is temporarily closed by a dust cover 32. A sealing member 33 closes an end of the channel section 29 facing in the setting direction S.

The boring head 5 has, at its end 24 facing in a direction opposite the setting direction S, a receiving section 34 for the sealing member 33 provided at the end of the channel section 29 facing in the setting direction. The receiving section 34 at the same time forms a stop for the channel section 29. Between the receiving section 34 of the boring head 5 and the front end 23 of the inner tube 21, there is provided a semi-circular ramp member 35. The functions of separate elements of the attachment element 1 and their cooperation will be described further below when describing a setting process of the attachment element 1.

The setting process of the attachment element 1 according to the present invention will be described substantially with reference to FIG. 2 and additionally to FIG. 1. The following values of the applied forces are indicated for the embodiment shown in FIGS. 1–2 and can be varied in accordance with particular requirements and the selected material.

With a drive tool (not shown) which engages the hexagon 7 of the attachment element 1 and which rotates and advances forward the attachment element 1, together with the boring head 5, a borehole is formed in a constructional component (not shown). The dust cover 32 prevents penetration of drillings in the interior of the inner tube 21 and into the elements arranged therein. The boring head 5 is pinned on the end 4 of the attachment element 1 facing in the setting direction S and remains fixed thereon during the boring process. After a predetermined depth of the borehole is reached, the drive tool is disengaged from the hexagon 7 and is replaced, with the use of an appropriate adaptor, by a squeezing device (not shown).

The plunger of the squeezing device acts on the piston 27 which, as it has been described above, is provided at the end 25 of the inner tube 21 facing in the direction opposite the setting direction. By the displacement of the piston 27 in the setting direction S, a squeezing process of components of the mortar mass, which is contained in the film bag 28, is initiated. Upon initiation of the squeezing process, the film bag 28 is displaced in a direction toward the channel section 29. When the film bag 28 lies on the bearing part 61, the film bag 28 opens, without being displaced further, as a result of pressure generated by a continuous displacement of the piston 27 in the setting direction S. The force necessary for opening the film bag 28 lies within the range of 150–200N. The mortar mass components flow into the mixer 30 and are mixed to form the necessary mass. The mixed mortar mass impacts the break cap 31 and is held thereby as the force for opening the break cap 31 lies within a range of about 700–800N.

The resistance at the break cap 31 is converted into a displacement force, with pressure being applied to the mortar mass. The bearing part 61, being fixedly secured in the inner tube 21, prevents the film bag 28 from blocking the channel section 29, and the film bag 28 cannot be further displaced in the direction toward the boring head 5. The channel section 29 becomes disengaged from the bearing part 61 upon displacement and is guided by the ramp member 35 toward the boring head 5. The sealing member 33 applies pressure to the dust cover 32, opening the same. The opening force, which is applied to the dust cover 32, lies within a range of about 200–300N.

As soon as the channel section 29 penetrates into the receiving section 34 at the rear end 24 of the boring head 5, the section 34 sealingly engages the front, the setting direction S, end of the channel section 29. Thereby, the suction channel 22 becomes closed, and no penetration of the mortar mass, which is squeezed through the channel section 29, into the interior of the receiving body 2 is possible. In order to prevent further displacement of the channel section 29 and a resulting blocking of openings 10.1, 10.2 by the channel section 29, the receiving section 34 is provided with a stop edge 36. When the channel section 29 reaches its end position with respect to the boring head 5, and upon continuation of the squeezing process, the mortar mass opens the break cap 31 with a force of about 700–800N, and the mortar mass is squeezed out through the openings 10.1 and 10.2 in an annular gap between the outer wall of the receiving body 2 and the wall of the borehole and toward the borehole bottom.

Figure 3:
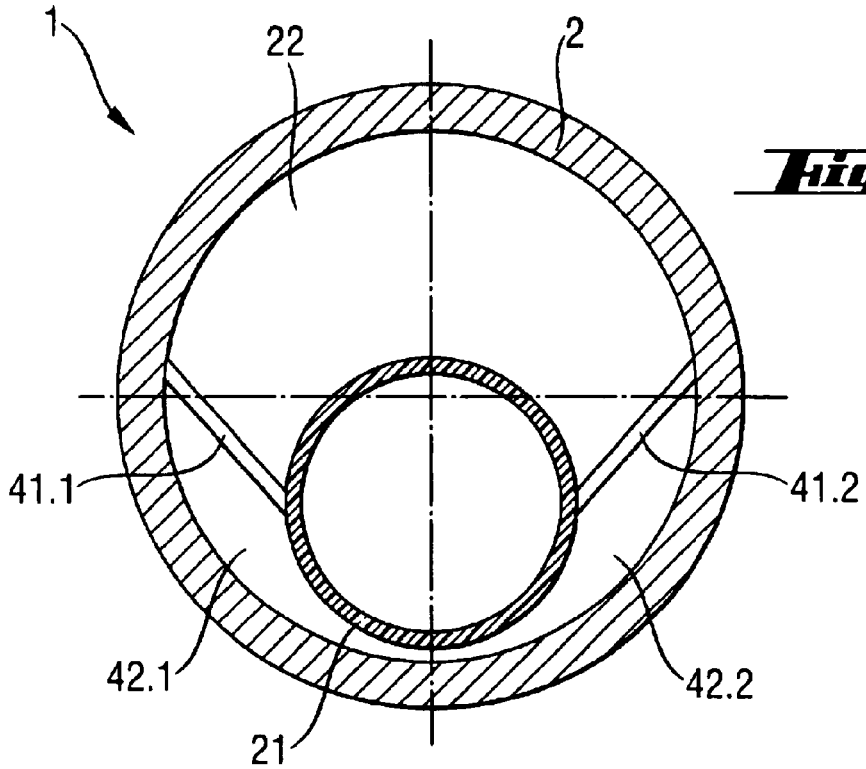
FIG. 3 a cross-sectional view, at an increased scale, along line III—III in FIG. 1.

FIG. 3 shows, as described above, a cross-sectional view along line III—III in FIG. 2. As shown in FIG. 3, the inner tube 21 is held eccentrically in the receiving body 2 with vanes 41.1. and 41.2 provided on the inner tube 21. Preferably, the vanes 41.1, 41.2 do not extend over the entire length of the inner tube 21 in order to provide a plurality of breakthroughs between the regions 42.1, 42.2 and the suction channel 22, so that drillings, which can penetrate into the regions 42.1 and 42.2, are removed through the suction channel 22.

Figure 4:
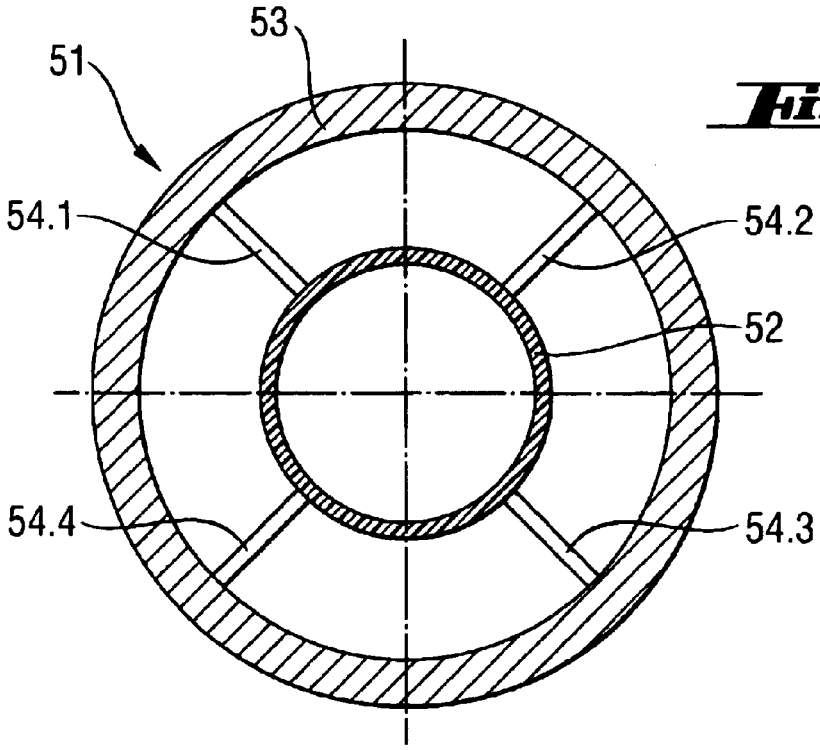
FIG. 4 a cross-sectional view similar to that of FIG. 3 of another embodiment of a fastening element according to the present invention.

A transverse cross-sectional view of another embodiment of an attachment element according to the present invention is shown in FIG. 4. In this embodiment, the inner tube 52 is arranged coaxially with the receiving body 23 of the attachment element 51. Spacers 54.1, 54.2, 54.3 and 54.4 retain the inner tube 51 in a predetermined position in the receiving body 53. The setting process of the attachment element 51 is the same as that of the attachment element 1.

In summary, according to the present invention, there is provided an attachment element, a rock anchor, that can be easily set in and that insures a high quality attachment. Because the annular gap between the attachment element and the borehole wall has a minimal width, a smaller amount of an expensive mortar mass is required for securing the attachment element according to the present invention in a borehole than is required for securing conventional attachment elements. In addition to a small amount of the mortar mass, the smaller thickness of the mortar mass layer in the gap positively or favorably influences contraction characteristics of the mortar mass during hardening which additionally improves the anchoring of the inventive attachment element.

Though the present invention was shown and described with references to the preferred embodiments, such are merely illustrative of the present invention and are not to be construed as a limitation thereof, and various modifications to the present invention will be apparent to those skilled in the art. It is, therefore, not intended that the present invention be limited to the disclosed embodiments or details thereof, and the present invention includes all of variations and/or alternative embodiments within the spirit and scope of the present invention as defined by the appended claims.

What is claimed is:

1. An attachment element (1;51), comprising a boring head (5); a hollow cylindrical receiving body (2; 53) having, at an end (4) thereof facing in a setting direction (S) of the attachment element (1; 51), means for receiving the boring head (5) and at an opposite end (6) thereof, engagement means (7); at least one outlet opening (10.1; 10.2) through which a mortar mass located in the receiving body (2; 53) is squeezed out; a channel section (29) extending between the mortar mass and the at least one outlet opening (10.1; 10.2); a piston (27) for applying pressure to the mortar mass for squeezing the mortar mass through the at least one outlet opening (10.1; 10.2); an inner tube (21; 52) arranged in the receiving body (2; 53) at a predetermined distance from an inner wall of the receiving body (2; 53) for forming at least one suction channel (22; 42.1; 42.2) which is defined by space between the inner wall of the receiving body and an outer wall of the inner tube, the mortar mass and the channel section (29) being arranged in the inner tube (21); and spacer means (41.1; 41.2; 54.1–54.4) provided between the inner wall of the receiving body (2; 53) and the outer wall of the inner tube (21) for retaining the inner tube (21) at the predetermined distance from the inner wall of the receiving body (2; 53).

2. An attachment element according to claim 1, wherein the mortar mass is stored in a bag (28).

3. An attachment element according to claim 1 wherein the inner tube (21) is eccentrically held in the receiving body (2).

4. An attachment element according to claim 1, wherein an end (23) of the inner tube (21) facing in the setting direction is spaced from the boring head (5).

5. An attachment element according claim 4, wherein the facing in the setting direction, end (23) of the inner tube (21) is closed with an openable dust cover (32).

6. An attachment element according claim 5, wherein an end of the channel section (20) facing in the setting direction (S) is closed with a break cap (31).

7. An attachment element according claim 1, further comprising mixing means (30) arranged in the channel section (29).

8. An attachment element according to claim 6, wherein the dust cover (32) has a tensile strength smaller than a tensile strength of the break cap (31).

9. An attachment element according to claim 1, wherein the channel section (29) is displaceable in the setting direction (5).

10. An attachment element according to claim 9, wherein the boring head (5) has a section (34) for sealingly receiving the channel section (29).

11. An attachment element according to claim 10, wherein the boring head (5) includes a stop (36) for limiting displacement of the channel section (29) within the receiving section (34).

12. An attachment element according to claim 1, wherein mechanical decoupling is providing between the mortar mass and channel section.

13. An attachment element according to claim 1, further comprising a guide element (35) provided between an end of the inner tube (21) facing in the setting direction (S) and the boring head (5).

* * * * *

UNITED STATES PATENT AND TRADEMARK OFFICE

CERTIFICATE OF CORRECTION

PATENT NO. : 6,955,504 B2
DATED : October 18, 2005
INVENTOR(S) : Erich Leibhard et al.

It is certified that error appears in the above-identified patent and that said Letters Patent is hereby corrected as shown below:

Title page,
Item [75], Inventors, should read:
-- Erich Leibhard, Munich (DE);
Roland Gienau, Westendorf (DE);
Wolfgang Ludwig, Schwabmünchen (DE) --.

Signed and Sealed this

Twenty-first Day of March, 2006

JON W. DUDAS
*Director of the United States Patent and Trademark Office*